US006695676B2

(12) United States Patent
Blake

(10) Patent No.: US 6,695,676 B2
(45) Date of Patent: Feb. 24, 2004

(54) TOY GUN

(76) Inventor: Kenneth D. Blake, 786 Deer Pen Rd., Winnfield, LA (US) 71483

( * ) Notice: Subject to any disclaimer, the term of this patent is extended or adjusted under 35 U.S.C. 154(b) by 0 days.

(21) Appl. No.: 10/210,730

(22) Filed: Aug. 1, 2002

(65) Prior Publication Data

US 2003/0181128 A1 Sep. 25, 2003

Related U.S. Application Data

(60) Provisional application No. 60/366,804, filed on Mar. 25, 2002, and provisional application No. 60/309,763, filed on Aug. 3, 2001.

(51) Int. Cl.[7] ..... A63H 33/30

(52) U.S. Cl. ..... 446/473; 446/475; 446/401; 446/405

(58) Field of Search ..... 446/475, 483, 446/397, 398, 401, 405, 473; 42/54, 55, 57, 58; 89/33.03, 33.16, 33.17, 157, 13.05

(56) References Cited

U.S. PATENT DOCUMENTS

| | | | | | |
|---|---|---|---|---|---|
| 332,741 | A | * | 12/1885 | Palmer | 89/12 |
| 386,535 | A | * | 7/1888 | Graham | 42/39.5 |
| 1,419,646 | A | | 6/1922 | Savage | |
| 2,024,125 | A | * | 12/1935 | Bochnak | 89/9 |
| 2,088,894 | A | * | 8/1937 | Cathcart | 42/57 |
| 2,836,919 | A | * | 6/1958 | Cathcart | 42/57 |
| 3,135,067 | A | | 6/1964 | Goldfarb | 46/195 |
| 3,369,535 | A | * | 2/1968 | Bonanno | 124/29 |
| 3,526,052 | A | * | 9/1970 | Ferri | 42/57 |
| 3,540,345 | A | * | 11/1970 | Wolfe | 89/13.05 |
| 3,906,662 | A | | 9/1975 | Suzukl et al. | 46/195 |
| 4,109,608 | A | | 8/1978 | Horikawa | 116/137 |
| 4,173,089 | A | * | 11/1979 | Gruaz | 42/58 |
| 4,215,512 | A | * | 8/1980 | Philipson | |
| 5,271,310 | A | * | 12/1993 | Muller | 89/33.4 |

FOREIGN PATENT DOCUMENTS

| | | | | | |
|---|---|---|---|---|---|
| GB | 2206291 | A | * | 1/1989 | F41C/3/08 |

* cited by examiner

*Primary Examiner*—Jacob K. Ackun
*Assistant Examiner*—Bena B. Miller
(74) *Attorney, Agent, or Firm*—John M. Harrison

(57) ABSTRACT

A toy gun including a housing and a pair of drums rotatably mounted in the housing. Multiple drum splines provided on each of the drums mesh with the drum splines on the other drum, and a drive mechanism operably engages the drums for selectively rotating the drums. A bubble strip having a plurality of air bubbles can be advanced between the drums responsive to operation of the drive mechanism. The drums successively rupture the air bubbles, which simulates the firing of bullets, and create a repetitive popping sound which resembles the sound of rapid gunfire from an automatic gun.

20 Claims, 7 Drawing Sheets

1
2
3
3a
3b
4
4a
4b
5
6
7
8
9
11
26
32
35
39
40
41
44
45
46
47
48
49
50

TOY GUN

CROSS-REFERENCE TO RELATED APPLICATIONS

This application claims the benefit of provisional application(s) Nos. 60/309,763, filed Aug. 3, 2001, and 60/366,804, filed Mar. 25, 2002.

BACKGROUND OF THE INVENTION

Field of the Invention

This invention relates to toy guns and more particularly, to a toy gun including a housing and a pair of splined drums rotatably mounted in the housing and disposed in meshing relationship with each other. A drive mechanism operably engages the drums for selectively rotating the drums. A bubble strip simulating bullets and having a plurality of air bubbles can be advanced between the drums responsive to operation of the drive mechanism, such that the drum splines of the drums successively rupture the air bubbles "bullets" and create a repetitive popping sound which resembles the sound of rapid gunfire from an automatic gun.

A common type of toy gun is the cap gun, which utilizes either a paper strip or a plastic ring impregnated with gunpowder to create a loud noise simulating the sound of gunfire when a trigger-actuated hammer strikes the gunpowder in the strip or ring. However, cap guns have been known to occasionally cause slight bums on the hands of cap gun users, in addition to creating small projectiles of paper or plastic which may cause eye injury upon detonation of the gunpowder.

Accordingly, an object of the present invention is to provide a toy gun which is safe to use.

Another object of this invention is to provide a toy gun which is capable of simulating the sound of gunfire.

Still another object of this invention is to provide a toy gun which is capable of simulating the sound of repetitive and rapid fire from a machine gun.

Yet another object of this invention is to provide a toy gun which is capable of rupturing successive air bubbles that simulate bullets in a bubble strip to create a repetitive popping sound that resembles the rapid-fire sound of an automatic gun.

A still further object of this invention is to provide a toy gun which typically includes a housing; a pair of drums rotatably mounted in the housing; multiple drum splines provided on each of the drums, which drum splines on each drum mesh with the drum splines on the other drum; a drive mechanism operably engaging at least one of the drums for selectively rotating the drums; and a bubble strip having a plurality of air bubbles "bullets" for advancement between the drums responsive to operation of the drive mechanism, such that the drum splines crimp the bubble strip and successively rupture the air bubbles "bullets" to create a repetitive popping sound which resembles the sound of rapid gunfire from an automatic gun.

SUMMARY OF THE INVENTION

These and other objects of the invention are provided in a toy gun typically including a housing and a pair of drums rotatably mounted in the housing. Multiple drum splines provided on each of the drums mesh with the drum splines on the other drum. A drive mechanism operably engages the drums for selectively rotating the drums. An elongated bubble (bullet) strip having a plurality of air bubbles "bullets" can be advanced between the drums responsive to operation of the drive mechanism. The drum splines crimp the bubble strip and successively rupture the air bubbles "bullets" to create a repetitive popping sound which resembles the sound of rapid gunfire from an automatic gun.

BRIEF DESCRIPTION OF THE DRAWINGS

The invention will be better understood by reference to the accompanying drawings, wherein.

DESCRIPTION OF THE PREFERRED EMBODIMENTS

Figures 1, 2, 3:
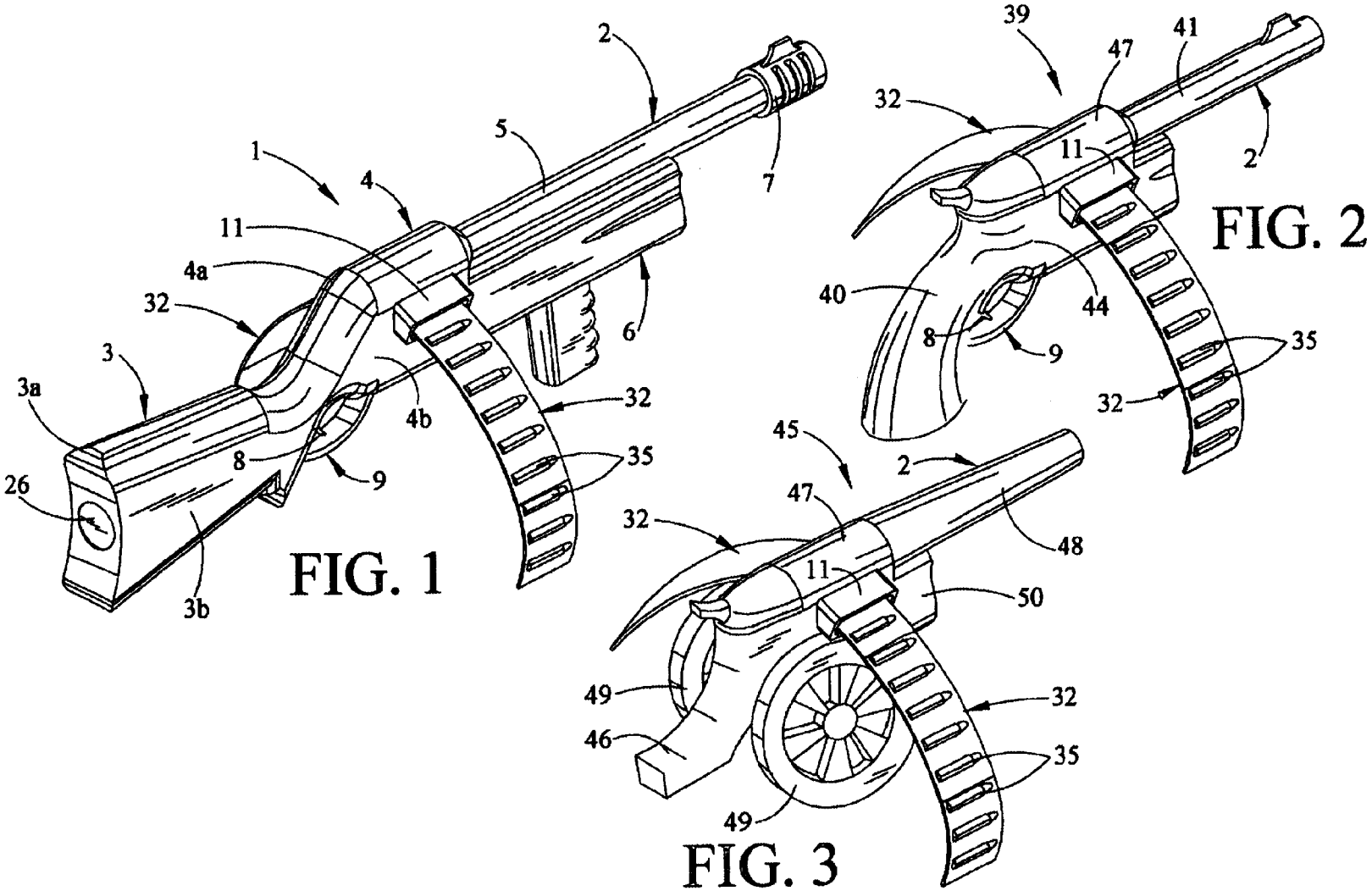
FIG. 1 is a rear perspective view of an illustrative embodiment of the toy gun of this invention, with the toy gun shaped in the configuration of a rifle.
FIG. 2 is a rear perspective view of an alternative, pistol-shaped embodiment of the toy gun of this invention.
FIG. 3 is a rear perspective view of a cannon-shaped embodiment of the toy gun.
Figure 4:
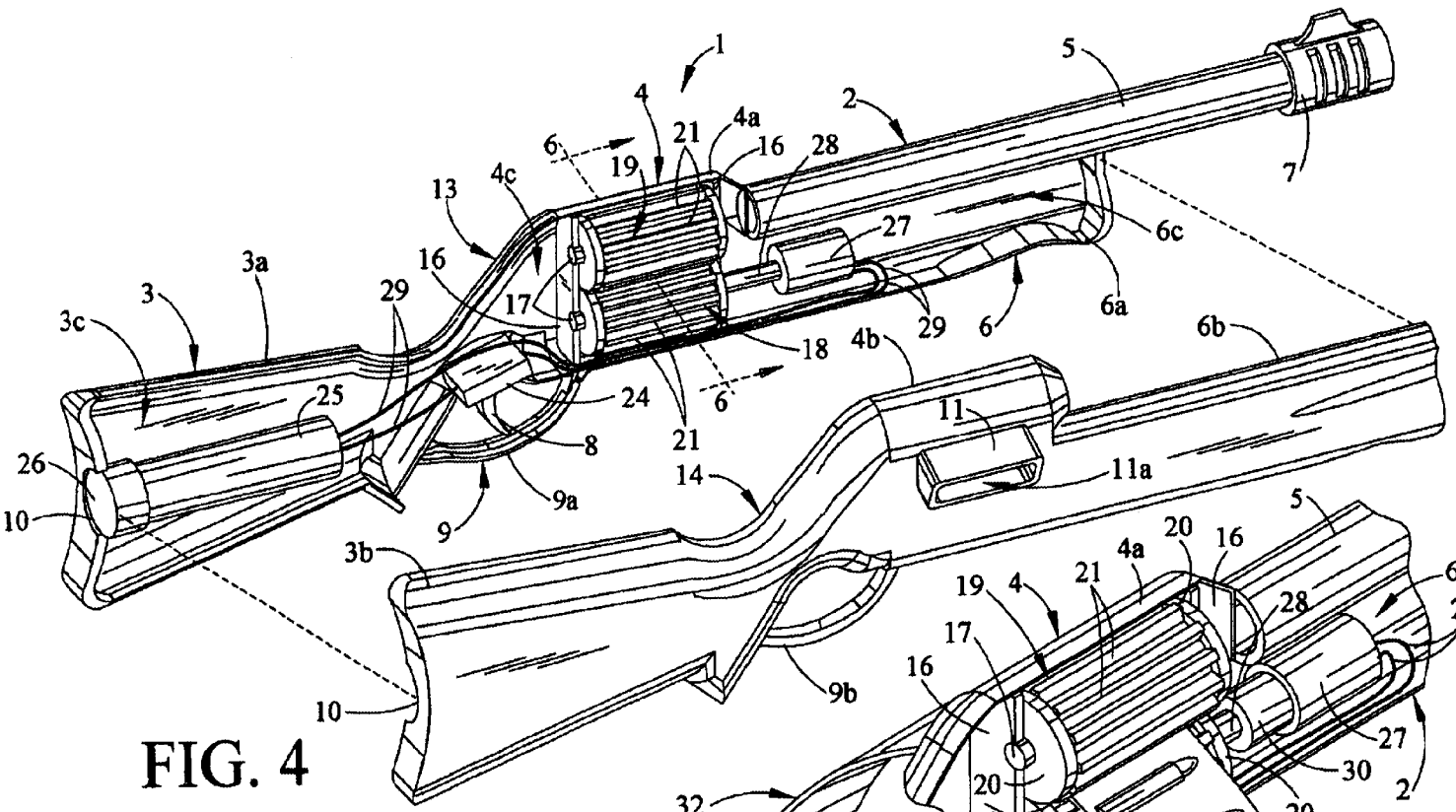
FIG. 4 is an exploded, perspective view of the rifle embodiment of the toy gun illustrated in FIG. 1.
Figure 5:
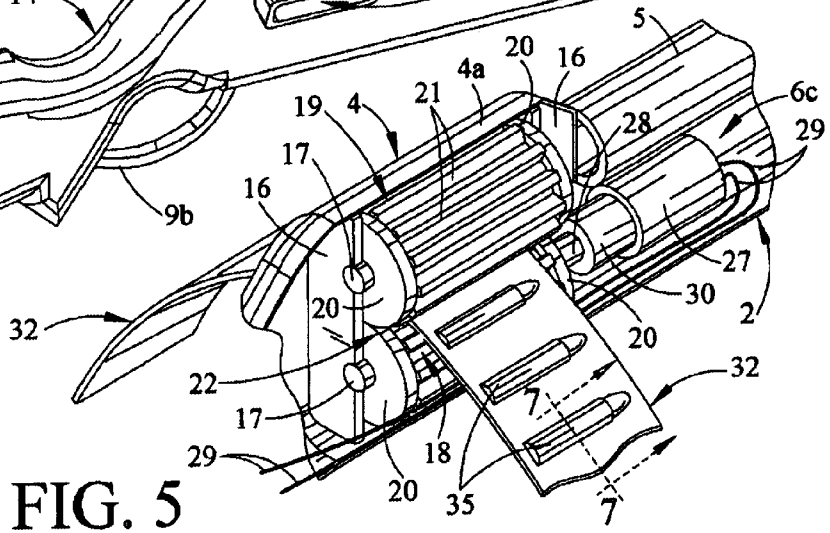
FIG. 5 is an enlarged perspective view, partially in section, of the toy gun illustrated in FIG. 4, with a safety clutch included in the drive train for the meshing drums of the toy gun.
Figures 6, 7, 8:
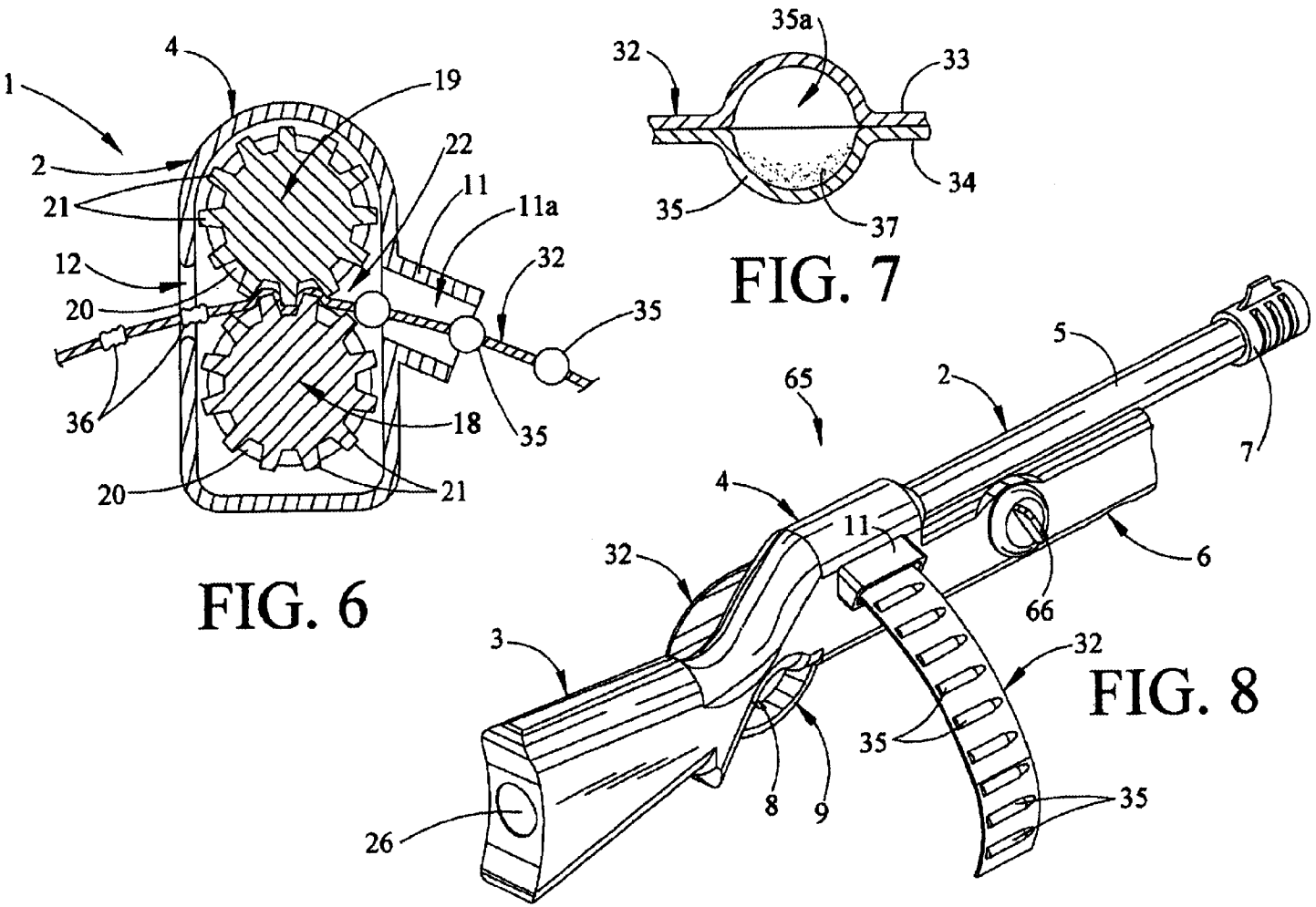
FIG. 6 is a transverse sectional view, taken along section lines 6—6 in FIG. 4, of the toy gun.
FIG. 7 is a sectional view, taken along section lines 7—7 in FIG. 5, of a typical bubble strip "bullet" belt component of the toy gun, illustrating a cross-sectional view of an air bubble "bullet" in the bubble strip belt.
FIG. 8 is a perspective view of another embodiment of the toy gun.

Referring initially to FIGS. 1 and 4–7 of the drawings, an illustrative embodiment of the toy gun of this invention is generally illustrated by reference numeral 1. The toy gun 1 typically includes a housing 2, which in the embodiment illustrated in FIG. 1 is shaped in the configuration of a rifle. The housing 2 typically includes a stock 3 and an elongated barrel 5, joined by a receiver 4, which barrel 5 may be fitted with a simulated muzzle 7. A grip 6 is typically provided on the underside of the barrel 5, and a trigger guard 9 extends between the stock 3 and the grip 6. As illustrated in FIG. 4, the housing 2 may be constructed of a shell 13, which is fitted to a complementary cover 14. Accordingly, the stock 3 of the housing 2 includes a shell portion 3*a* of the shell 13, which shell portion 3*a* joins a congruent cover portion 3*b* of the cover 14 to define the stock 3 having a stock interior 3*c*. In like manner, the receiver 4 of the housing 2 is characterized by a shell portion 4*a* which joins a matching cover portion 4*b* to define the receiver 4 having a receiver interior 4*c*. The grip 6 includes a shell portion 6*a* which joins a cover portion 6*b* to define a grip interior 6*c*. Further, the trigger guard 9 may include a shell portion 9*a* of the shell 13 which joins a cover portion 9*b* on the cover 14 to define the trigger guard 9. As further illustrated in FIG. 4, a pair of parallel drum support tabs 16 spans the receiver interior 4*c* in spaced-apart relationship to each other, and an elongated drive drum 18 and an elongated idle drum 19, each provided with multiple drum splines 21, is rotatably mounted between the drum support tabs 16 with the drum splines 21 of the drive drum 18 meshing with the drum splines 21 of the idle drum 19, as illustrated in FIG. 6. The drive drum 18 and the idle drum 19 may each be characterized by a pair of drum discs 20, between which the drum splines 21 extend, as particularly illustrated in FIG. 5. Drum axles (not illustrated) extend centrally through the respective drive drum 18 and idle drum 19, and the ends of each drum axle are seated in a corresponding pair of respective axle receptacles 17 on the respective drum support tabs 16 to rotatably mount the drive drum 18 and the idle drum 19 between the drum support tabs 16. It is understood that any suitable alternative mechanism may be used to rotatably mount the drive drum 18 and the idle drum 19 in the housing 2. An elongated strip receiver 11, defining a receiver opening 11*a* which is disposed in substantial alignment with the mesh junction 22 between the drive drum 18 and the idle drum 19, may be provided on the cover 14 of the housing 2. As illustrated in FIG. 6, an elongated exit opening 12 is provided in the shell 13 in substantial alignment with the mesh junction 22 between the drive drum 18 and the idle drum 19, the purpose of which receiver opening 11*a* and exit opening 12 will be hereinafter described.

As further illustrated in FIGS. 4 and 5, an electric motor 27 is mounted in the grip interior 6*c* of the grip 6, and is fitted with a motor shaft 28 which engages the drive drum 18. In one embodiment, illustrated in FIG. 5, the motor shaft 28 extends from a safety clutch 30 engaged by the electric motor 27, the purpose of which safety clutch 30 will be hereinafter described. In the embodiment illustrated in FIG. 4, the motor shaft 28 is coupled directly to the electric motor 27. In the embodiments of the toy gun 1 illustrated in FIGS. 4 and 5, the electric motor 27 is connected by wiring 29 to a switch 24, contained in the receiver interior 4*c* and fitted with a trigger 8 which extends from the housing 2 adjacent to the trigger guard 9. The electric motor 27 and the switch 24 are each further connected by means of additional wiring 29 to a battery receptacle 25 for receiving one or multiple batteries (not illustrated), as needed to power the electric motor 27. The battery receptacle 25 is typically contained in the stock interior 3*c* of the stock 3 and fitted with a receptacle cap 26 which can be accessed through a cap opening 10 (FIG. 4) provided in the rear end of the stock 3. The receptacle cap 26 can be removed from the battery receptacle 25 to insert and remove batteries (not illustrated) in the battery receptacle 25, as needed. Accordingly, depression of the trigger 8 completes the circuit between the switch 24, the battery receptacle 25 and the electric motor 27 and energizes the electric motor 27 to rotate the drive drum 18 through the motor shaft 28.

As illustrated in FIGS. 1 and 7 and hereinafter further described, the toy gun 1 is designed to utilize a bubble strip 32, which simulates an ammunition belt to create a repetitive popping sound which resembles the rapid-fire sound of an automatic gun. The bubble strip 32 is similar in design to conventional plastic air bubble packing sheets or strips and, as illustrated in FIG. 7, typically includes an elongated, plastic strip body 32*a* having a first panel strip 33 which is sealed against a plastic second panel strip 34. The first panel strip 33 and the second panel strip 34 are separated from each other at multiple air bubbles 35, each simulating a bullet and defined by an air cavity 35*a*, which air bubbles 35 are spaced from each other at regular intervals along the longitudinal axis of the bubble wrap strip 32. As illustrated in FIG. 1, the air bubbles 35 may be shaped in the size and configuration of bullets, as illustrated, or in the configuration of any type of ammunition. In one embodiment, some or all of the air cavities 35*a* may contain small quantities of powder 37, as further illustrated in FIG. 7, for generating simulated smoke as the air bubbles "bullets" 35 are ruptured as hereinafter described. In another embodiment, the air cavity 35*a* of each air bubble 35 contains air without powder. It is understood that the strip body 32*a* of the bubble strip 32 may have any alternative structure other than the first panel strip 33 and the second panel strip 34 to incorporate the air bubbles 35 therein.

Referring next to FIGS. 1 and 4–6 of the drawings, in use of the toy gun 1, one end of the bubble strip 32 is initially inserted in the receiver opening 11*a* of the strip receiver 11 on the housing 2, until the bubble strip 32 contacts the mesh junction 22 between the meshing drive drum 18 and idle drum 19. The trigger 8 is then depressed to close the circuit between the switch 24, the battery compartment 25 and the electric motor 27, whereupon the electric motor 27 rotates the motor shaft 28 which, in turn, rotates the drive drum 18, and the drive drum 18 rotates the idle drum 19 by means of the meshing drum splines 21. In the embodiment illustrated in FIG. 5, the electric motor 27 rotates the drive shaft 28 through the safety clutch 30. Accordingly, the drum splines 21 draw the bubble strip 32 between the drive drum 18 and the idle drum 19 and crimp the bubble strip 32 as the drum splines 21 of the drive drum 18 engage the drum splines 21 of the idle drum 19, as illustrated in FIG. 6. The meshing drum splines 21 further crush and rupture the air bubbles 35, such that the air rapidly escapes from the air cavities 35*a* (FIG. 7) of the successive air bubbles 35 and creates a repetitive popping sound which resembles the rapid-fire sound of an automatic weapon. Furthermore, in the embodiment of the toy gun 1 in which powder 37 (FIG. 7) is contained in some or all of the air cavities 35*a* of the air bubbles 35, the powder 37 escapes from the rupturing air cavities 35*a* and wafts through the exit opening 12 of the housing 2 to resemble smoke. As the bubble strip 32 is gradually advanced between the drive drum 18 and idle drum 19 and out the exit opening 12 of the housing 2 by continued operation of the trigger 8, the air bubbles 35 of the bubble strip 32 are successively ruptured to form multiple bursted air bubbles 36, as illustrated in FIG. 6. With respect to the toy gun 1 illustrated in FIG. 5, it will be appreciated by those skilled in the art that under circumstances in which the drive drum 18 encounters resistance to rotation such as, for example, responsive to inadvertent lodging of a child's finger (not illustrated) between the drive drum 18 and the idle drum 19, the safety clutch 30 disengages the motor shaft 28 from the electric motor 27 to prevent continued rotation of the drive drum 18 and the idle drum 19.

Referring next to FIG. 2 of the drawings, in another embodiment of the invention the toy gun is generally illustrated by reference numeral 39. The housing 2 of the toy gun 39 is shaped in the configuration of a pistol, having a body 44 which includes a handgrip 40 and is fitted with a receiver 47 from which extends a barrel 41. A drive drum 18 and an idle drum 19 (FIG. 4) are rotatably mounted in the body 44 and the receiver 47, as heretofore described with respect to the toy gun 1 illustrated in FIG. 1. An electric motor 27 (FIG. 4) typically provided in the body 44 engages the drive drum 18, and a battery receptacle 25 (FIG. 4) for receiving one or multiple batteries (not illustrated), as needed to power the electric motor 27, is provided typically in the handgrip 40. A strip receiver 11 is typically provided on the housing 2 for receiving a bubble strip 32. Accordingly, actuation of a trigger 8 provided on the handgrip 40 operates the electric motor 27 to rotate the drive drum 18 and idle drum 19 and draw the bubble strip 32 through the housing 2 such that the drum splines 21 crimp the bubble strip 32 and rupture the successive air bubbles 35 to produce a repetitive popping sound, in the manner heretofore described with respect to the toy gun 1 illustrated in FIGS. 1 and 6.

Referring next to FIG. 3 of the drawings, in yet another embodiment the toy gun is generally illustrated by reference numeral 45 and is shaped in the configuration of a cannon. The housing 2 of the toy gun 45 typically includes a foot 46, which extends rearwardly from a body 50 that is typically fitted with a pair of wheels 49 and a receiver 47, from which receiver 47 a barrel 48 extends. A trigger (not illustrated) is typically provided on the underside of the body 50. Accordingly, the trigger (not illustrated) of the toy gun 45 can be depressed to actuate an electric motor 27 (FIG. 4) contained typically in the body 50, to advance the bubble strip 32 through a strip receiver 11 provided on the housing 2 and rupture the air bubbles 35, in the manner heretofore described with respect to the toy gun 1 illustrated in FIG. 6.

Figure 9:
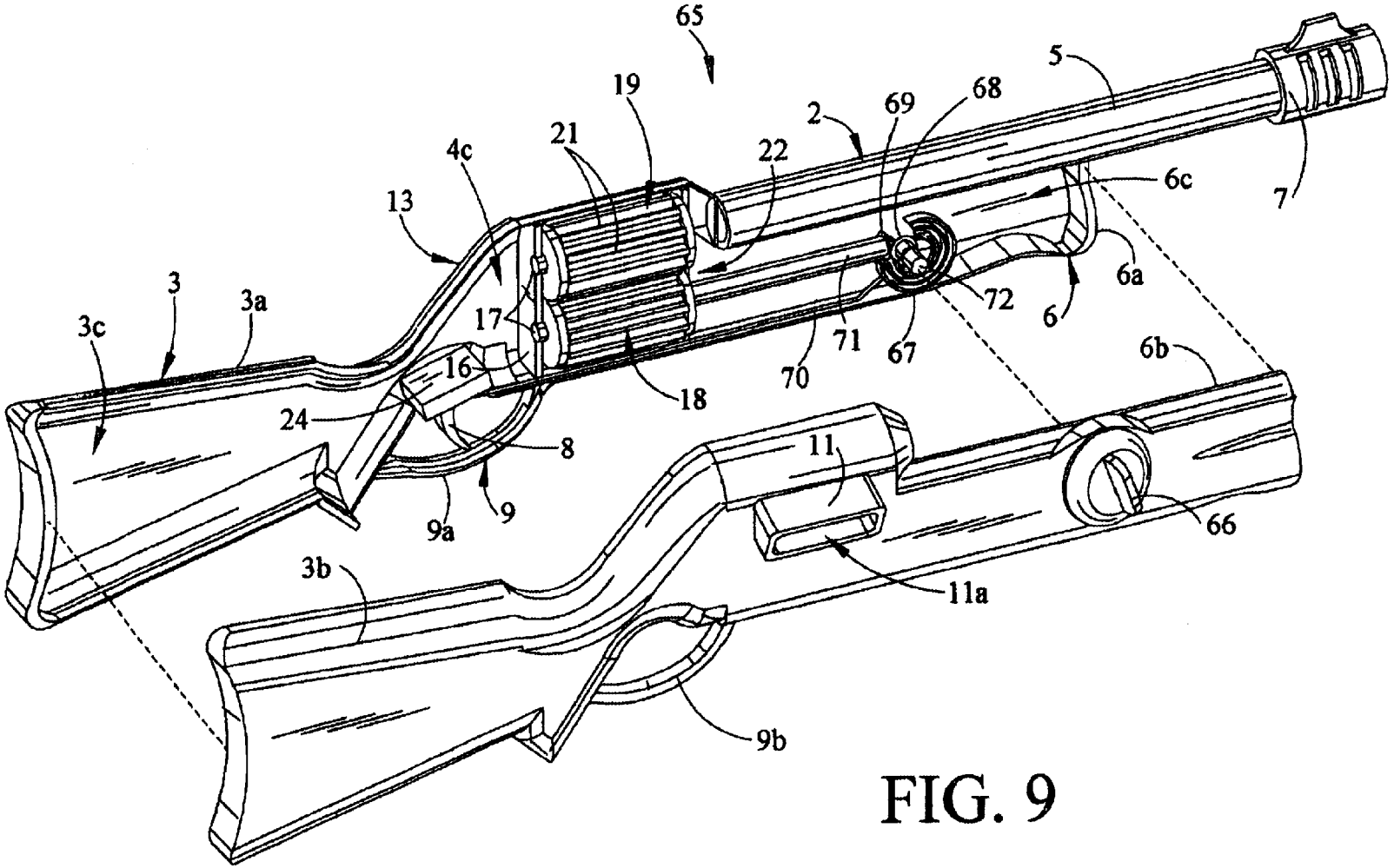
FIG. 9 is an exploded, perspective view of the toy gun illustrated in FIG. 8.

Referring next to FIGS. 8 and 9 of the drawings, in yet another embodiment of the invention the toy gun is generally illustrated by reference numeral 65, and utilizes a tensioned coil spring 67 contained in the housing 2, rather than the electric motor 27 heretofore described with respect to FIG. 4, to rotate a drive drum 18 and a meshing idle drum 19 contained in the housing 2 responsive to depression of a trigger 8 on the toy gun 65. The cover portion 6*b* of the grip 6 of the housing 2 is fitted with a spring windup dial 66, which engages the coil spring 67 provided in the grip interior 6*c* in such a manner that the coil spring 67 is tensioned responsive to rotation of the spring windup dial 66, according to the knowledge of those skilled in the art. The coil spring 67 is further coupled to a switch 24 typically by means of a spring release rod 70, such that depression of a trigger 8 in the switch 24 releases tension of the coil spring 67. The coil spring 67 is mounted on a spring shaft 72 which further mounts a spring gear 68 that meshes with a shaft gear 69 provided on a drive shaft 71, coupled to the drive drum 18 for rotation with the drive shaft 71. Accordingly, depression of the trigger 8 releases tension in the coil spring 67 by actuation of the spring release rod 70, which coil spring 67 rotates the drive drum 18 through the spring shaft 72, the spring gear 68, the shaft gear 69 and the drive shaft 71 to advance a bubble strip 32 through the strip receiver 11 and between the drive drum 18 and the idle drum 19 in the housing 2, as heretofore described.

Figures 10, 11:
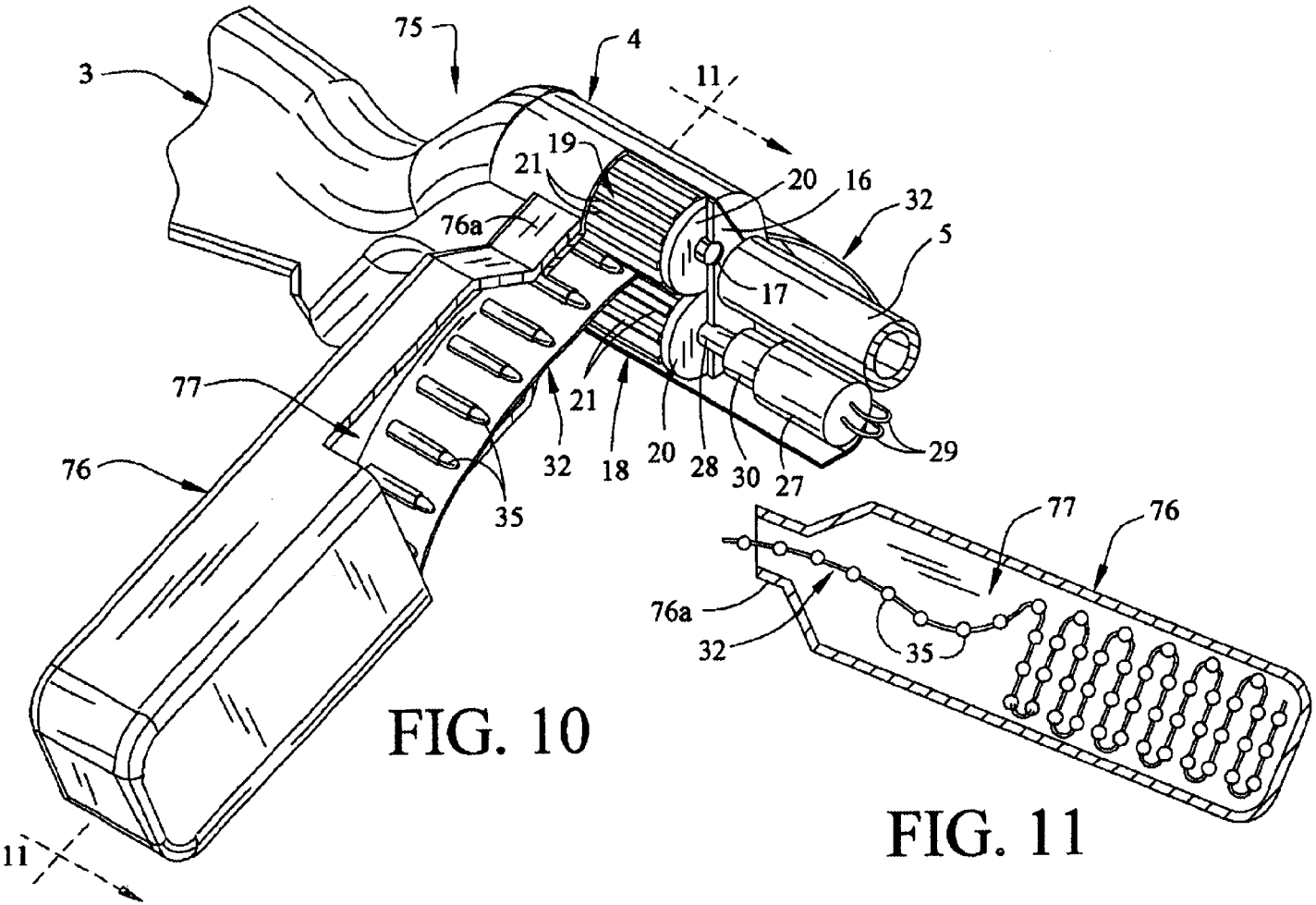
FIG. 10 is a perspective view, partially in section, of yet another embodiment of the toy gun.
FIG. 11 is a longitudinal sectional view, taken along section lines 11—11 in FIG. 10, of an ammo (bubble bullet and belt) container component of the toy gun.

Referring next to FIGS. 10 and 11 and again to FIG. 6 of the drawings, in still another embodiment the toy gun of this invention is generally indicated by reference numeral 75 and is fitted with an elongated ammo container 76, having a container interior 77 for containing the bubble strip 32. The ammo container 76 typically includes a container neck 76*a* for typically removable attachment to the receiver 4 of the toy gun 75, typically by means of tabs (not illustrated) provided on the container neck 76*a* and which are removably inserted in respective tab slots (not illustrated) provided in the receiver 4, or by any other suitable means known to those skilled in the art. In use, the ammo container 76 is removed from the receiver 4 and the bubble strip 32 is placed in the container interior 77 in a multi-folded configuration, as illustrated in FIG. 11, to facilitate placement of a substantial length of the bubble strip 32 in the container interior 77. One end of the bubble strip 32 is extended from the container interior 77 through the container neck 76*a* thereof and is inserted between the meshing drive drum 18 and idle drum 19. After the ammo container 76 is replaced on the receiver 4 of the toy gun 75, the trigger 8 (FIG. 1) of the toy gun 75 is operated to energize the electric motor 27, which rotates the drive drum 18 and the idle drum 19 through the motor shaft 28. Alternatively, the drive drum 18 of the toy gun 75 may be coupled to a coil spring 67 (FIG. 9) through a drive shaft 71 for rotating the drive drum 18, as heretofore described. Accordingly, the drum splines 21 of the drive drum 18 and idle drum 19 pull the bubble strip 32 through the receiver 4 and crimp the bubble strip 32 to progressively rupture the air bubbles 35, in the manner heretofore described with respect to FIG. 6. The expended portion of the bubble strip 32, having the ruptured air bubbles 36 (FIG. 6), extends through an exit opening 12 (FIG. 6) provided the housing 2 of the toy gun 75, in the manner heretofore described with respect to FIG. 6. After the entire bubble strip 32 has been dispensed from the container interior 77, the ammo container 76 can be removed from the receiver 4 and a replacement bubble strip 32 positioned in the container interior 77 for use. While the ammo container 76 of the toy gun 75 has been described above as being removably attached to the receiver 4, it is understood that the ammo container 76 may be fixedly attached to the receiver 4 instead. In that case, the ammo container 76 may be fitted with a removably cap or panel (not illustrated) for placement of the bubble strip 32 in the container interior 77.

Figures 12, 13:
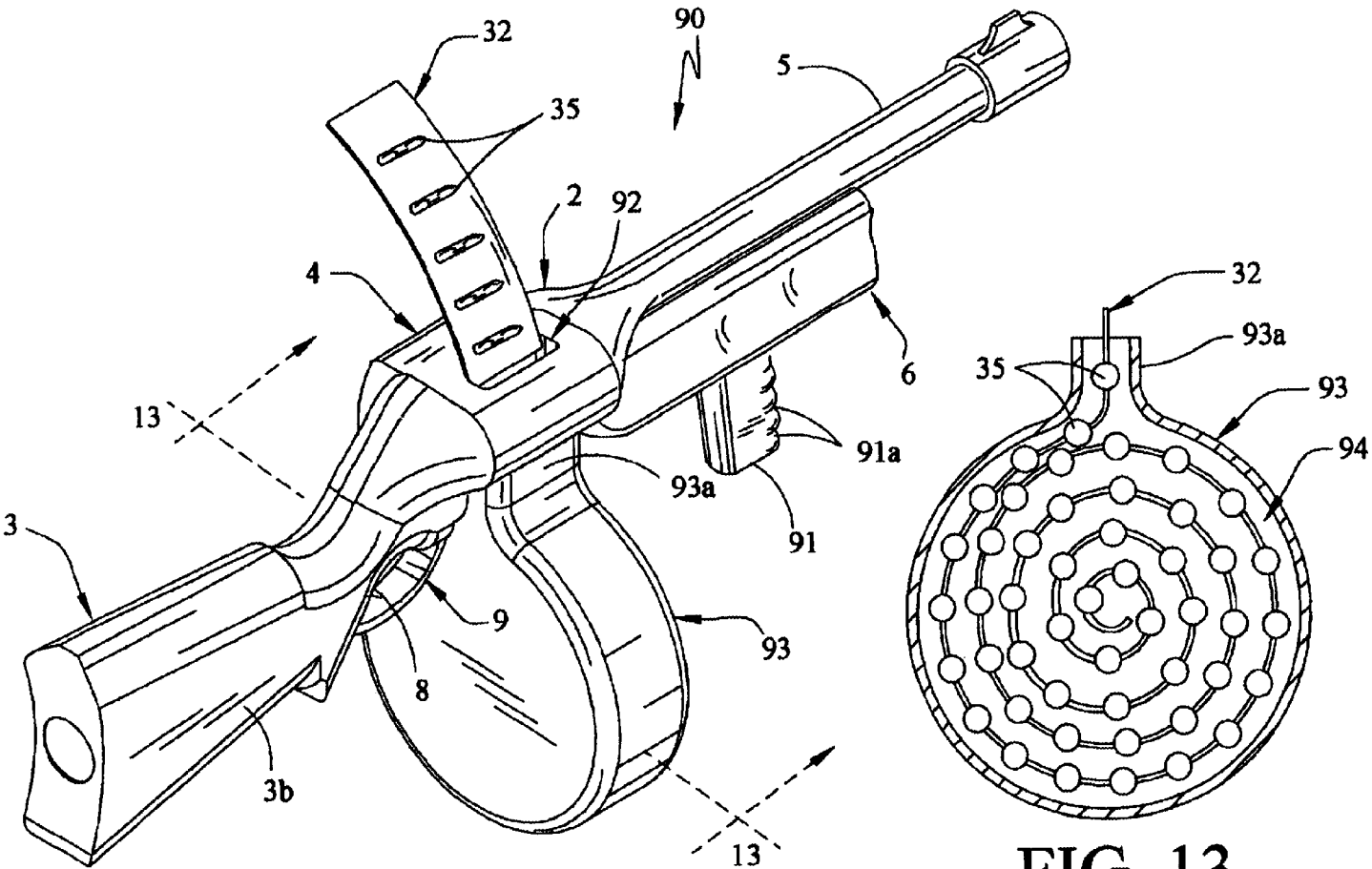
FIG. 12 is a rear perspective view of yet another embodiment of the toy gun.
FIG. 13 is a sectional view, taken along section lines 13—13 in FIG. 12, of an alternative ammo container component of the toy gun.

Referring next to FIGS. 12 and 13 of the drawings, another embodiment of the toy gun of this invention, generally indicated by reference numeral 90, resembles a Gatling gun and includes a circular ammo container 93 for containing the bubble strip 32 in a wound or coiled configuration and dispensing the bubble strip 32 to the drive drum 18 and idle drum 19 as heretofore described with respect to the ammo container 76 of FIG. 10. The circular ammo container 93 may have a container neck 93*a* that is typically removably attached to the bottom of the receiver 4, according to the knowledge of those skilled in the art and through which container neck 93*a* one end of the bubble strip 32 extends, as illustrated in FIG. 13. A strip slot 92 may be provided in the receiver 4 for receiving the expended portion of the bubble strip 32 after the air bubbles 35 thereof are ruptured, as hereinafter described, and a handle 91, typically provided with multiple finger notches 91*a*, may extend downwardly from the grip 6 of the toy gun 90. In use, the bubble strip 32 is placed in the circular container interior 94 typically in a wound or coiled configuration, as illustrated in FIG. 13. One end of the bubble strip 32 is extended from the container neck 93*a* and inserted between the drive drum 18 and the idle drum 19 of the toy gun 90, as heretofore described with respect to the ammo container 76 of FIG. 10, and the container neck 93*a* of the ammo container 93 is attached to the receiver 4. Upon energizing the electric motor 27 (FIG. 10) or coil spring 67 (FIG. 9) by depression of the trigger 8 (FIG. 1) of the toy gun 90, the drive drum 18 rotates the idle drum 19, which together crimp the bubble strip 32 and rupture the air bubbles 35 thereof. As the air bubbles 35 of the bubble strip 32 are ruptured in the receiver 4, the expended portion of the bubble strip 32, containing the ruptured air bubbles 35, is extended from the receiver 4 through the strip slot 92. After the entire length of bubble strip 32 has been dispensed from the container interior 94, the ammo container 93 can be removed from the receiver 4 of the toy gun 90 and a replacement bubble strip 32 placed in the container interior 94 and used. While the circular ammo container 93 of the toy gun 90 has been described above as being removably attached to the receiver 4, it is understood that the circular ammo container 93 may be fixedly attached to the receiver 4 instead. In that case, the circular ammo container 93 may be fitted with a removably cap or panel (not illustrated) for placement of the bubble strip 32 in the container interior 94.

Figure 14:
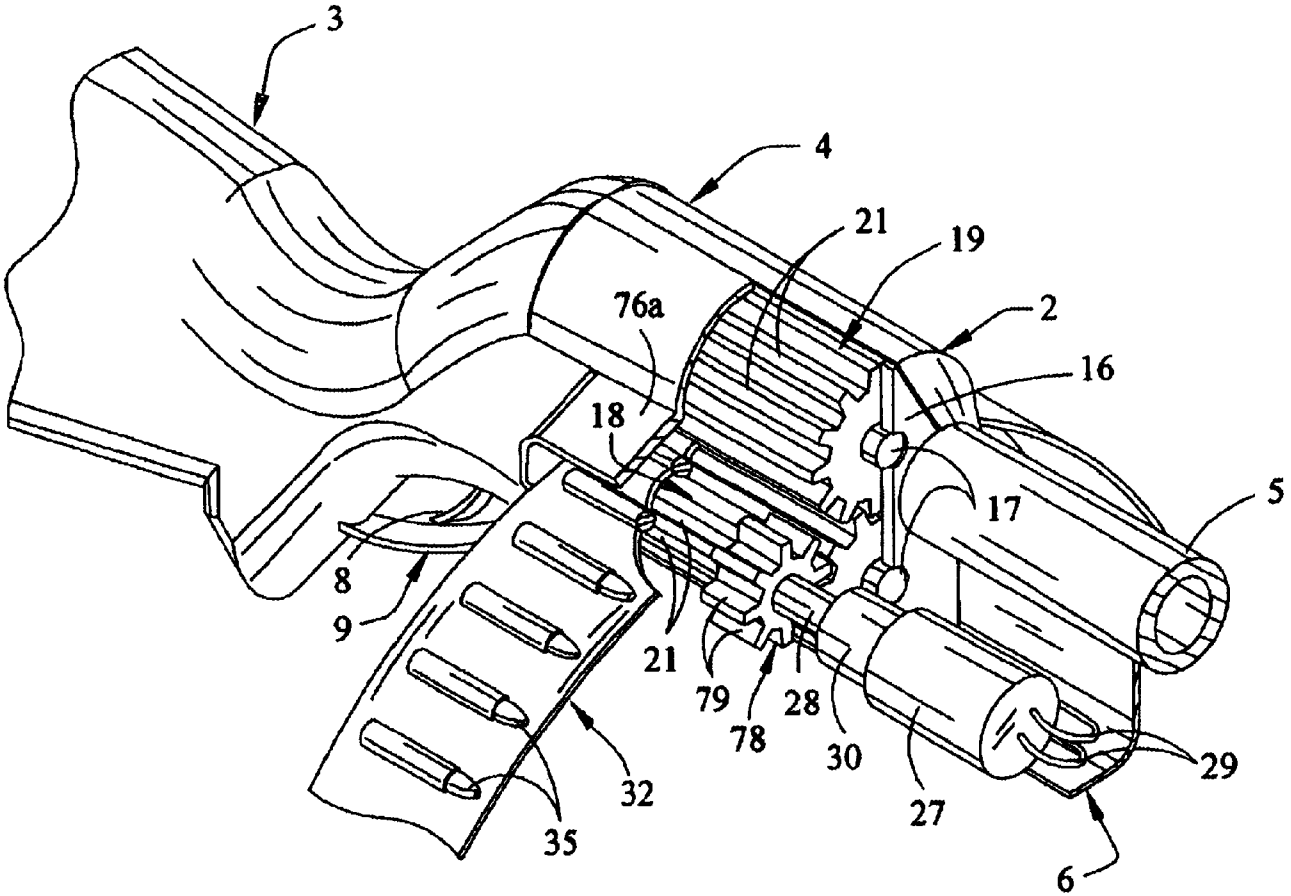
FIG. 14 is a perspective view, partially in section, of still another embodiment of the toy gun of this invention, illustrating an alternative drive mechanism for the toy gun.

Referring next to FIG. 14 of the drawings, an alternative drive mechanism for the various embodiments of the toy gun of this invention is illustrated, and includes a drive drum 18 and an idle drum 19 rotatably disposed in the receiver 4, typically between a pair of drum support tabs 16 by means of axle receptacles 17. The drive drum 18 and idle drum 19 each has multiple drum splines 21 which mesh with the drum splines 21 of the other idle drum 19 or drive drum 18, respectively. A drive pinion 78, fitted with multiple pinion teeth 79, is mounted on a motor shaft 28 engaged by an electric motor 27, as illustrated. Alternatively, the drive pinion 78 may be mounted on a drive shaft 71 (FIG. 9), coupled for rotation by a tensioned coil spring 67 (FIG. 9) as heretofore described with respect to the toy gun 65 illustrated in FIG. 9. As further illustrated in FIG. 14, the pinion teeth 79 of the drive pinion 78 mesh with the drum splines 21 of the drive drum 18. By operation of the electric motor 27 or the tensioned coil spring 67, respectively, the drive pinion 78 rotates with the motor shaft 28 or drive shaft 71 (FIG. 9), respectively, which drive pinion 78 in turn rotates the meshing drive drum 18 and the drive drum 18 rotates the meshing idle drum 19. Accordingly, the meshing drum splines 21 of the drive drum 18 and idle drum 19, respectively, draw the bubble strip 32 through the receiver 4 and progressively crimp and rupture the air bubbles 35 of the bubble strip 32 to simulate the rapid-fire sound of an automatic gun, in the manner heretofore described with respect to FIG. 6.

It will be appreciated by those skilled in the art that the toy gun of this invention, in the various embodiments thereof, is safe to use by children of all ages and can be constructed in any size or shape, including the shape of a rifle, a pistol, a cannon, a bomb (not illustrated) or other firearm, in non-exclusive particular. It is understood that any of the various embodiments of the toy gun can utilize either the electric motor 27 (FIG. 4) or the coil spring 67 (FIG. 9) to rotate the drive drum 18 and the idle drum 19, as heretofore described. It is further understood that the drive drum 18 and idle drum 19 may be fitted with a crank (not illustrated) to resemble an old-fashioned Gatling gun, for example, which crank is rotated to rotate the drive drum 18 and idle drum 19 and facilitate popping the air bubbles "bullets" 35 in the bubble strip 32. Furthermore, any of the embodiments of the toy gun may incorporate the safety clutch 30 (FIG. 5) between the electric motor 27 and the motor shaft 28, as heretofore described with respect to the toy gun 1. It is understood that the housing 2 can be constructed of plastic, wood or metal. Referring again to FIGS. 7 and 8 of the drawings, it is understood that the air bubbles 35 of the bubble strip 32 can be shaped in the configuration of any form of ammunition, including rifle and machine guns, bullets or the like in non-exclusive particular.

While the preferred embodiments of the invention have been described above, it will be recognized and understood that various modifications can be made in the invention and the appended claims are intended to cover all such modifications which may fall within the spirit and scope of the invention.

Having described my invention with the particularity set forth above, what is claimed is:

1. A toy gun comprising:

a housing shaped in a selected configuration;

a first drum and a second drum rotatably mounted in said housing;

a plurality of drum splines provided on said first drum and a plurality of drum splines provided on said second drum;

wherein said plurality of drum splines provided on said first drum are disposed in meshing relationship to said plurality of drum splines provided on said second drum;

a drive mechanism operably engaging said first drum for selectively rotating said first drum; and a bubble strip comprising a plurality of air bubbles for advancement between said first drum and said second drum responsive to operation of said drive mechanism.

2. The toy gun of claim 1 wherein said selected configuration is a pistol shape, a rifle shape, a cannon shape or a Gatling gun shape.

3. The toy gun of claim 1 wherein said drive mechanism is a coil spring or an electric motor.

4. The toy gun of claim 3 wherein said selected configuration is a pistol shape, a rifle shape, a cannon shape or a Gatling gun shape.

5. The toy gun of claim 1 comprising powder provided in at least one of said plurality of air bubbles of said bubble strip.

6. The toy gun of claim 5 wherein said selected configuration is a pistol shape, a rifle shape, a cannon shape or a Gatling gun shape.

7. The toy gun of claim 5 wherein said drive mechanism is a coil spring or an elecric motor.

8. The toy gun of claim 7 wherein said selected configuration is a pistol shape, a rifle shape, a cannon shape or a Gatling gun shape.

9. A toy gun comprising:

a housing shaped in a selected configuration;

a first drum and a second drum rotatably mounted in said housing;

a plurality of first drum splines provide on said first drum and a plurality of second drum splines provided on said second drum;

wherein said plurality of first drum splines provide on said first drum are disposed in meshing relationship to said plurality of second drum splines provided on said second drum;

a bubble strip comprising a plurality of air bubbles for advancement between said first drum splines and said second drum splines;

a drive pinion having a plurality of pinion teeth disposed in meshing relationship to said plurality of first drum splines provide on said first drum; and a drive mechanism operably engaging said drive pinion for selectively rotating said drive pinion and said first drum and said second drum and crushing said air bubbles in said bubble strip between said first drum splines and said second drum splines.

10. The toy gun of claim 9 wherein said selected configuration is a pistol shape, a rifle shape, a cannon shape or a Gatling gun shape.

11. The toy gun of claim 9 wherein said drive mechanism is a coil spring or an electric motor.

12. The toy gun of claim 11 wherein said selected configuration is a pistol shape, a rifle shape, a cannon shape or a Gatling gun shape.

13. A method of simulating a rapid-sound fire of an automatic gun, comprising:

providing a toy gun comprising a housing; a first drum and a second drum rotatably mounted in said housing; a plurality of drum splines provided on said first drum and said second drum, respectively, with said plurality of drum splines of said first drum meshing with said plurality of drum splines of said second drum; and a drive mechanism operably engaging said first drum for rotating said first drum;

providing a bubble strip comprising a plurality of air bubbles;

operating said drive mechanism; and advancing said bubble strip between said first drum and said second drum, whereby said plurality of drum splines of said first drum and said plurality of drum splines of said second drum rupture said plurality of air bubbles of said bubble strip and simulate the rapid-fire sound of the automatic gun.

14. The method of claim 13 comprising powder provided in at least one of said plurality of air bubbles, respectively, for simulating smoke while simulating the rapid-fire sound of the automatic gun.

15. A toy gun comprising:

a housing shaped in a configuration generally resembling a firearm;

a first drum and a second drum rotatably mounted in said housing;

a plurality of first drum splines provide on said first drum and a plurality of second drum splines provided on said second drum;

wherein said plurality of first drum splines provide on said first drum are disposed in meshing relationship to said plurality of second drum splines provide on said second drum;

a drive mechanism operably engaging said first drum for selectively rotating said first drum;

a bubble strip comprising plurality of air bubbles for advancement between said first drum and said second drum and crushing said air bubbles between said first drum splines and said second drum splines responsive to operation of said drive mechanism; and an ammo container carried by said housing.

16. The toy gun of claim 15 wherein said ammo container has a substantially elongated configuration.

17. The toy gun of claim 15 wherein said drive mechanism is a coil spring or an electric motor.

18. The toy gun of claim 17 wherein said container has a substantially elongated configuration.

19. The toy gun of claim 15 wherein said ammo container has a substantially circular configuration.

20. The toy gun of claim 19 wherein said drive mechanism is a coil spring or an electric motor.

* * * * *